United States Patent [19]

Ohtomo et al.

[11] 4,067,769

[45] Jan. 10, 1978

[54] HEAT RESISTANT AND FLAME RESISTANT PAPERS

[75] Inventors: Koichiro Ohtomo, Takatsuki; Tsuyoshi Nakamo, Osaka, both of Japan

[73] Assignee: Kanebo, Ltd., Tokyo, Japan

[21] Appl. No.: 603,041

[22] Filed: Aug. 8, 1975

Related U.S. Application Data

[63] Continuation of Ser. No. 392,646, Aug. 29, 1973, abandoned.

[30] Foreign Application Priority Data

| | | |
|---|---|---|
| Sept. 5, 1972 | Japan | 47-88951 |
| Sept. 5, 1972 | Japan | 47-88952 |

[51] Int. Cl.[2] ..... D21H 5/12

[52] U.S. Cl. ..... 162/157 R; 162/164 EP; 260/831; 260/840; 260/841; 260/842; 260/848

[58] Field of Search ..... 260/838, 840, 841, 842, 260/843, 848, 831; 264/184, 176 F, 236; 162/146, 157 R

[56] References Cited

U.S. PATENT DOCUMENTS

| | | | |
|---|---|---|---|
| 2,315,087 | 3/1943 | Cuvier | 260/840 |
| 2,430,868 | 11/1947 | Francis | 136/146 |
| 2,999,788 | 9/1961 | Morgan | 162/157 R |
| 3,129,133 | 4/1964 | Doyle et al. | 162/164 |
| 3,547,773 | 12/1970 | Spence | 162/157 R |
| 3,650,102 | 3/1972 | Economy et al. | 264/176 F |
| 3,651,199 | 3/1972 | Blume | 260/838 |
| 3,716,521 | 2/1973 | Economy et al. | 264/176 F |
| 3,848,044 | 11/1974 | Hagiwara et al. | 260/838 |
| 3,928,526 | 12/1975 | Koyama | 264/236 |
| 3,931,386 | 1/1976 | Kimura et al. | 264/236 |

*Primary Examiner*—S. Leon Bashore
*Assistant Examiner*—Peter F. Kratz
*Attorney, Agent, or Firm*—Blanchard, Flynn, Thiel, Boutell & Tanis

[57] ABSTRACT

Heat resistant and flame resistant papers composed of at least 60% by weight of phenolic fibers having a hardened degree of 3–30% by weight, which are obtained by melt spinning a phenolic resin and cross-linking the resulting filaments with an aldehyde.

12 Claims, No Drawings

HEAT RESISTANT AND FLAME RESISTANT PAPERS

This is a continuation of application Ser. No. 392,646, filed Aug. 29, 1973 and now abandoned.

The present invention relates to papers having a high heat resistance and a high flame resistance consisting mainly of phenolic fibers obtained by hardening filaments formed by a melt spinning of phenolic resin and a method for producing said papers.

Recently, heat resistant materials and non-flammable materials have been rapidly developed owing to the progress of air planes and the progress of super high buildings, respectively. For example, as in PBI fibers (Celanese Corp.) and Nomex fibers (DuPont Co.), novel heat resistant high molecular weight materials have been produced by utilizing a ring closing polycondensation reaction which applies a heterocyclic synthetic chemistry. However, these fibers are generally synthesized through an interfacial polycondensation reaction and therefore they are very expensive and further are not completely satisfactory in their non-flammability property.

Considering these points, as fibers having a high heat resistance and a high flame resistance, phenolic fibers composed of a hardened novolak have been developed.

The inventors, in the production of paper-like products having a high heat resistance and a high flame resistance using such phenolic fibers as the main material, have investigated variously with respect to the fiber itself, the selection of configuration, the selection of appropriate binder and the production condition and the present invention has been accomplished.

An object of the present invention is to provide papers having a high heat resistance and a high flame resistance.

Another object is to provide a method for producing said papers commercially and easily.

The present invention consists in heat resistant and flame resistant papers consisting mainly of at least 60% by weight of phenolic fibers having a hardened degree of 3–30% by weight, in which fibers obtained by a melt spinning of a phenolic resin are hardened with an aldehyde, such as formaldehyde into a three dimensional structure.

The term "phenolic fibers" to be used in the present invention generally means the following product. At least one of phenol and modified phenols, such as cresol, chlorophenol and the like is subjected to a condensation polymerization with aldehydes exemplified by formaldehyde to form a thermoplastic phenolic resin of novolak or resol and this resin is heated and melted under a non-oxidizing atmosphere and extruded into filaments and then, for example the resulting filaments composed of novolak are subjected to a cross-linking reaction with formaldehyde in the presence of hydrochloric acid catalyst to form finally infusible and non-flammable fibers.

The more preferable phenolic fibers are obtained by hardening the filaments composed of novolak, which are obtained as described above, with hydrochloric acid-formaldehyde system in the presence of urea, thiourea and the methylol derivatives thereof or ethyleneurea, ethylenethiourea and the methylol derivatives thereof to form fibers containing urea or thiourea. Because the phenolic fibers containing urea or thiourea are generally more improved in the heat resistance by 50°–70° C than the phenolic fibers having only methylene bonds.

The production of the phenolic fibers will be explained in more detail.

The fibers composed of novolak obtained as mentioned above are immersed in a mixed solution of 0.1–25% by weight of a strong acid, such as hydrochloric acid, sulfuric acid and the like and 0.5–35% by weight of aldehydes exemplified by formaldehyde at room temperature for 0–2 hours and the temperature of the mixed solution is raised to a temperature of 50°–105° C by 0.05–10 hours and further the fibers are treated in said solution at a temperature of 50°–105° C for 0–20 hours.

Alternatively, in the above described hardening reaction, after the temperature is raised, the treatment at the temperature of 50°–105° C is effected within 0–2 hours to harden the outer layer of the fibers and the thus treated fibers are immersed in a mixed solution of 0.2–15% by weight of ammonia or amines and 1–35% by weight of formaldehyde and the like at room temperature and then the temperature is raised to 70°–95° C by 0.5–1 hour and said temperature is maintained for 0.5–10 hours.

In addition, after the above described partial hardening, the fibers are immersed in a mixed solution of 0.1–25% by weight of an acidic catalyst or a basic catalyst, 1–30% by weight of formaldehyde and the like, 0.5–15% by weight of urea or thiourea and the like and 1–50% by weight of alcohols, such as methanol, ethanol, ketones, such as acetone, methyl ethyl ketone or ethers such as dioxane, tetrahydrofuran at room temperature and the temperature is raised to 50°–95° C by a time of 0.5–2 hours and the same temperature is maintained for 0.5–25 hours to form the phenolic fibers, which contain urea bond and the like and are infusible, insoluble in a solvent, and non-flammable and have a high heat resistance.

In the production of the above described novolak fibers, it is possible to produce modified novolak fibers by melt spinning of the mixture of the novolak with the other thermoplastic polymer. Such polymers include polyamides, such as nylon-6, nylon-66, nylon-610, nylon-11, nylon-12, or polyamides using carboxylic acids or diamines containing aromatic or the other alicyclic rings, for example terephthalic acid, isophthalic acid, metaxylylenediamine, paraxylylenediamine, as one component, or copolymers composed thereof, polyesters, such as polyethylene terephthalate, polyestereth-ers, such as polyoxyethyleneoxybenzoate the copolymers thereof, polyurethane or polyolefins, such as polyethylene, polypropylene, polystyrene and the like.

The thus obtained modified novolak fibers can be converted into insoluble, infusible, heat resistant and non-flammable phenolic fibers by forming a three dimensional structure through the above described hardening process. Particularly, the phenolic fibers obtained by hardening the novolak fibers formed by melt spinning of the mixture of the novolak and 1–15% by weight of polyamides, polyesters or polyolefins are more flexible and are more excellent in the yarn properties than the phenolic fibers not containing said polymers and such phenolic fibers are more preferable as the paper material.

An additional important characteristic consists in that the phenolic fibers can simplify the paper-making step. Namely, the phenolic fibers are formed into a knitted or woven fabric or a non-woven fabric and then heat pressed or said fabric is immersed in a phenol or dimethylformamide with respect to polyamides, in a chlorophenol with respect to polyesters, or in an aromatic compound with respect to olefin compounds and then heat pressed. By such means the papers can be formed without using a binder.

In the present invention, of course it is possible to use a general paper-making process.

As mentioned above, the thermoplastic novolak fibers are converted into a three dimensional structure gradually from the outer layer to the inner layer with formaldehyde and the phenolic fibers having unhardened portion in the inner portion obtained by adjusting the hardened degree to a range of 35–65% of the cross-section of the fiber, are formed into a knitted or woven fabric or a non-woven fabric and then heat pressed or said fabric is immersed in a solvent, such as alcohols, ketones, ethers, aromatic hydrocarbons and the like to dissolve off a part of the inner portion and then deformed into papers by heating or heat press. In this case, if necessary, the above described hardening treatment may be effected.

The above described partially hardened fibers can be produced by decreasing the reaction time after the temperature is raised, within 0–2 hours in the above described hardening process.

In the present invention, the hardened degree must be 3–30% by weight in the above described three dimensional formation. Because, in less than 3% by weight, the heat resistance and flame resistance which are the characteristic of the phenolic fibers, can not be satisfactorily obtained, while in more than 30% by weight, the cross-linking density is too high and even if the heat resistance and flame resistance are satisfied, the fibers are generally brittle. The term "hardened degree" means the rate of weight increase owing to the three dimensional formation.

In the thus obtained fibers, the fineness is preferred to be 0.1–20 deniers, more particularly 0.3–10 deniers and the fiber length is preferred to be 0.3–100 mm, more particularly 0.5–50 mm. Of course, in the general process, the filaments or staples may be formed into a knitted or woven fabric or a non-woven fabric and applied with a binder and then heated or heat pressed.

Then an explanation will be made with respect to the binder.

The present invention aims at the heat resistant and flame resistant papers and therefore the binder is naturally limited. For example, when polyvinyl alcohol, carboxymethyl cellulose or soluble starch is used, the applied amount should be less than 25%, preferably less than 20% and more preferably less than 15%, in order to retain the heat resistance and flame resistance possessed by the phenolic fibers. The preferable binders include aromatic polyamides, polyesters, polyethers, polyimides, phenolic resin, epoxy resin, and polyolefins.

In general, since in the phenolic fibers the phenol ring has a high compatibility with the other polymers, various binders can be used and for example, aromatic polyamides obtained by interfacial polycondensation of isophthalic dichloride or terephthalic dichloride with m- or p- phenylenediamide, polyesters, such as polyethylene terephthalate, polyethers, such as 2,6-dimethylpolyphenylene oxide, polyamideimides obtained by reacting a condensate of isophthalic dichloride and m-phenylenediamine with pyromellitic anhydride and heating the reaction product, polyimides obtained from an aromatic diamine and dicarboxylic anhydride may be used. In the above described polymers, the polymerization degree is not limited but it is preferable to select properly depending upon the use object. The preferable binders include polyethylene, polypropylene, polyvinyl chloride, styrene-butadiene copolymer, melamine resin, urea resin and the like. In the present invention phenolic resin and epoxy resin are particularly preferable.

The preferable heat resistant and flame resistant papers consist of 60–99.5% by weight of phenolic fibers and 0.5–30% by weight of a phenolic resin and/or an epoxy resin as a binder.

When an epoxy resin is used as the binder, the resulting papers are characterized in the heat resistance and when a phenolic resin is used as the binder, the resulting paper is characterized in the non-flammability.

The epoxy resins to be used in the present invention include an addition product of bisphenols, such as bisphenol A and epichlorohydrin and the polymers obtained therefrom. By using an epoxy resin composed of halogenated bisphenols, such as tetrabromobisphenol-A, the flame resistance of the phenolic fibers can be maintained.

The phenolic resins to be used in the present invention include novolak or resol resins and as mentioned above the adhesion with the phenolic fibers is high and the heat resistance can be maintained and particularly the phenolic resins are excellent in the non-flammability.

The novolak is a resin obtained by reacting phenols, such as phenol, cresol, tert-butylphenol, octylphenol, chlorophenol and the like with aldehydes, such as formaldehyde, the molar ratio of aldehyde/phenol being 0.6–1.5, in the presence of an inorganic acid, such as hydrochloric acid, sulfuric acid or an organic acid, such as oxalic acid and in general the resin is dissolved in a solvent, such as methanol, acetone and can be hardened by heating at a temperature of 120°–150° C in the presence of paraformaldehyde and hexamethylenetetramine and the like. In this case, an amount of paraformaldehyde added is about 5–10% based on the resin.

The resol resin is phenolic resins having a molecular weight of about 250–3,000 and having free methylol group in the phenol ring and bonded with methylene or methylene ether linkage, which are obtained by addition polycondensation of phenol and aldehyde in a molar ratio of aldehyde/phenol of 1.5–3.0 in the presence of a basic catalyst of potassium hydroxide, sodium carbonate, ammonia, hexamethylenetetramine, amine and the like. Said resins are hardened by heating at a temperature of 120°–170° C or heating at a temperature of 80°–150° C in the presence of a catalyst of paratoluenesulfonic acid or phenolsulfonic acid.

The phenolic fibers according to the present invention, when the novolak or resol resin is used as the binder, have chemical bond with the resin in the hardening of the resin and the adhesion is particularly high.

Furthermore, depending upon the application, the modification of the resin with higher aliphatic acid amides, aromatic amines, resins and the like may be used.

The usually used binders may be used together with the above described epoxy resins or phenolic resins. However, in this case in order to maintain the heat resistance and the flame resistance, the amount of said binders to be added should be less than 30% by weight based on the epoxy resins or phenolic resins.

In the present invention, the phenolic fibers of the main component of the paper must be 60–99.5% by weight. Because, when the amount is less than 60% by weight, the characteristics of the phenolic fibers can not be attained and the heat resistant and flame resistant papers can be obtained, while when the amount is more than 99.5% by weight, the strength of the resulting papers is poor.

The amount of the binders is 0.5–30% by weight, preferably 1–25% by weight, more particularly 3–20% by weight. In order to obtain the papers, the amount must be more than 0.5% by weight and when the amount is more than 30% by weight, it is impossible to obtain the papers having a high strength and the heat resistance and flame resistance which are the characteristics of the phenolic fibers, are deteriorated.

It is possible to contain the other heat resistant fibers or non-flammable and difficultly flammable fibers together with the phenolic fibers within the range which does not deteriorate the heat resistance and flame resistance. In general, the amount is less than 20%.

When an oxidation resistance is particularly required in addition to the heat resistance and flame resistance, it is desirable to mix 3–20% by weight of polyolefin fibers, for example polyethylene, polypropylene, polystyrene and the like. Particularly, polyvinyl chloride is preferable.

The polyolefin fibers are mixed with the phenolic fibers and the mixture is made into papers in a conventional process. Alternatively, the mixture is heat pressed at a temperature of higher than the softening temperature of said olefins, that is 60°–140° C, preferably 70°–120° C with adding the binder or without adding the binder, whereby papers having a high oxidation resistance and excellent heat resistance and flame resistance can be produced.

The papers having a high heat resistance and a high flame resistance and a water absorbing property can be produced. Namely, the polyvinyl alcohol fibers are mixed with the phenolic fibers and the mixture is made into papers with adding the binder or without adding the binder.

The paper making process may be effected by a conventional process. In this case, the phenolic fibers having a length of 0.3–100 mm are dispersed in a binder solution of 0.5–30% by weight and screened on a wire gauze and then dried and if necessary, heated or compressed with a hot roll to form various shaped papers.

However, in the present invention the phenolic fibers can be formed in filaments or staple fibers and the phenolic fibers are formed into a knitted or woven fabric or a non-woven fabric and immersed in a binder-containing solution and dried and then heated or subjected to a hot roll. Alternatively, the binder solution is sprayed on the knitted or woven fabric or a non-woven fabric and the thus treated fabric is heated. The spraying process is desirable, because the binder solution can be utilized efficiently.

Thus, the papers having high heat resistance and flame resistance can be produced without deteriorating the characteristics of the phenolic fibers and the resulting papers are particularly suitable for wall papers of air planes or high buildings. By utilizing the heat resistance, the papers are valuable for electric insulating papers and separaters of lead battery.

The following examples are given for the purpose of illustration of this invention and are not intended as limitations thereof. In the examples, "part" means part by weight.

EXAMPLE 1

1,410 g of phenol, 1,180 g of formalin (37% aqueous solution), 20 g of oxalic acid and 300 g of methanol were reacted at 100° C for 3 hours while stirring and then added with a large amount of cold water to stop the reaction.

The resulting phenolic resin was dissolved in methanol and then unreacted phenol, formaldehyde, methanol and a small amount of water were distilled off to obtain a thermosplastic novolak resin having a number average molecule weight of 820. 500 g of the thus obtained novolak resin was crushed and dried thoroughly and then introduced into an externally heating dissolving vessel made of stainless steel and having 1 capacity. The inside of the vessel was purged with gaseous nitrogen repeatedly and the novolak resin was melted at an inner temperature of 160° C.

The thus melted novolak resin was extruded out through a nozzle heated at 160° C and having 18 orifices, each having a diameter of 2.5 mm, through a gear pump from the bottom of said dissolving vessel at an extrusion rate of 3 g/min, and filaments of 45 d/18 f were taken up on a bobbin by means of a take-up machine arranged at 1.5 m below the nozzle at a spinning velocity of 1,050 m/min. Then, the filaments were cut on the bobbin and separated from the bobbin in a tow form.

100 Parts of the resulting unhardened novolak fibers was immersed in 1,500 parts of a mixed aqueous solution of 18% by weight of formaldehyde and 18% by weight of hydrochloric acid at 20° C and a temperature of the mixed aqueous solution was raised to 95° C gradually by 3 hours and then the hardening treatment was repeated at 95° C for a long time. Two kinds of phenolic fibers were obtained by the treating times of 0.5 hour and 10 hours.

The fibers obtained by such a treatment of 2 hours were extracted with methanol to remove the unhardened portion and the hollow percentage was determined by the cross-sectional photograph and it has been found that the outer portion (hardened portion) was 62% of total cross-section.

The yarn properties of the two kinds of fibers are shown in the following Table 1.

Table 1

| Sample | Hardening time | Hardened* degree (wt%) | Yarn properties Strength (g/d) | Yarn properties Elongation (%) |
|---|---|---|---|---|
| A | 0.5 | 5.3 | 1.3 | 15 |
| B | 10 | 17.2 | 1.5 | 27 |

* Percentage of the weight increase due to the hardening (three dimensional formation).

Formaldehyde and melamine (molar ratio of formaldehyde/melamine being 3.2) were reacted at 60° C for 2 hours in the presence of 5 mol% of aqueous solution of sodium hydroxide to obtain an original condensate, from which the alkali was removed and the original condensate was washed with water. Then water and the unreacted product were distilled off at 90° C under 25 mmHg for 1 hour, after which methanol was added thereto to form 5% solution.

To the solution of the melamine-formaldehyde original condensate in methanol was added 5% by weight based on the melamine-formaldehyde original condensate of p-toluenesulfonic acid to prepare a binder solution.

Then, the above described phenolic fibers were cut into a length of 3–5 cm respectively and subjected to carding. Thereafter, from these fibers random webs having a weight of 50 g/m² were formed by a conventional process.

These webs were impregnated with the above described binder solution and the impregnated webs were dried at 80° C for 30 minutes to form paper-like products having a thickness of 0.7 mm.

For effecting a heat resistance test, 10 sample pieces, each having a width of 15 mm and a length of 250 mm, were cut from the formed paper-like products in the longitudinal direction and the transversal direction respectively and said sample pieces were heat-treated in a hot air circulating drier adjusted at 155° C for 10 days and with respect to these sample pieces, the tensile strength was determined following to JIS P 8113 and the strength and elongation retaining percentages were determined.

$$\text{Strength (elongation) retaining percentage (\%)} = \frac{\text{Strength (elongation) prior to heating} - \text{Strength (elongation) after heating}}{\text{Strength (elongaton) prior to heating}} \times 100$$

The test for flammability was effected as follows.

The sample pieces having the same size as described above (longitudinal direction) were suspended and the lower end of the sample was applied to an alcohol lamp fire for 20 seconds and the carbonized distance and the flame size were observed to obtain the following results.

Table 2

| Sample | Tensile strength of sample piece prior to heat treatment (Kg/mm²) | | Elongation of sample piece prior to heat treatment (%) | | Strength retaining percentage (%) | | Elongation retaining percentage (%) | | Flammability | |
|---|---|---|---|---|---|---|---|---|---|---|
| | Longitudinal direction | Transversal direction | Longitudinal direction | Transversal direction | Longitudinal direction | Transversal direction | Longitudinal direction | Transversal direction | Carbonization distance | Flame size |
| A | 14.8 | 12.5 | 4.2 | 5.3 | 91 | 90 | 90 | 88 | 48 mm | Small |
| B | 22.3 | 21.3 | 3.7 | 5.5 | 97 | 94 | 92 | 93 | 20 mm | No flame |

From the above Table 2, it can be seen that the paper-like products according to the present invention are high in the heat resistance and the flame resistance. Particularly, even if sample B having a high hardened degree is exposed to the fire, said sample does not at all flame and is only carbonized in the surface of the paper.

EXAMPLE 2

Phenolic fibers A produced in Example 1 were cut into a length of 2–10 mm, immersed in methanol and made into a sheet on a wire gauze. The sheet was dried in air at room temperature for 1 hour and then hot-pressed under a pressure of 1.5 Kg/cm² by means of a hot press machine adjusted at 130° C to obtain a paper-like product having a thickness of 0.15 mm. The resulting paper-like product, which had been produced without the use of a binder, was tested with respect to the tensile strength, heat resistance and flammability following to the test method described in Example 1 to obtain results as shown in the following Table 3.

Table 3

| | Tensile strength of sample piece prior to heat treatment (Kg/mm²) | | Elongation of sample piece prior to heat treatment (%) | | Strength retaining percentage (%) | | Elongation retaining percentage (%) | | Flammability | |
|---|---|---|---|---|---|---|---|---|---|---|
| | Longitudinal direction | Transversal direction | Longitudinal direction | Transversal direction | Longitudinal direction | Transversal direction | Longitudinal direction | Transversal direction | Carbonization distance | Flame size |
| Present invention | 12.0 | 11.2 | 3.5 | 4.8 | 94 | 95 | 93 | 92 | 23 mm | No flame |

From the above Table 3, it can be seen that the paper-like product of the present invention, which has been produced without the use of a binder in Example 2, is somewhat inferior in the strength and elongation to the paper-like product obtained in Example 1, but is somewhat superior in the heat resistance and flammability.

EXAMPLE 3

100 Parts of the unhardened novolak fibers produced in Example 1 was immersed in 2,000 parts of a mixed aqueous solution of 18% by weight of formaldehyde and 18% by weight of hydrochloric acid at 25° C, and a temperature of the mixed aqueous solution was raised to 95° C gradually by 1 hour, and then the hardening treatment was effected for 10 minutes at this temperature, and the treated fibers were immediately washed with water to obtain partially hardened fibers.

Then, the partially hardened fibers were divided into two parts. One part of the partially hardened fibers was immersed in a mixed aqueous solution composed of 9 parts of 37% formaldehyde aqueous solution and 1 part of 30% ammonia water, and a temperature of the mixed aqueous solution was raised to 95° C by 1 hour, and then the hardening reaction was effected at 95° C for 1 hour to obtain hardened fibers C. The hardened fibers C were infusible, insoluble and nonflammable fibers having a hardened degree of 11.2%, a fineness of 3.1 d, a strength of 1.28 g/d and an elongation of 59%.

Another part of the partially hardened fibers was immersed in a mixed aqueous solution composed of 1 part of 37% formaldehyde aqueous solution, 1 part of 35% hydrochloric acid, 3 parts of methanol and 0.2 part of urea at 40° C, and a temperature of the mixed aqueous solution was raised to 63° C by 30 minutes, and then the hardening reaction was effected at this temperature for 4 hours to complete the hardening. The hardened fibers were washed with water and dried to obtain phenolic fibers D. The phenolic fibers D contained 5.7% of cross-linked urea and were light yellow insoluble, infusible and non-flammable fibers having a hardened degree of 17.5%, a fineness of 3.2 d, a strength of 1.78 g/d and an elongation of 56%.

The above obtained two kinds of fibers were cut into a length of 5 cm, and then formed into random webs having a weight of 70 g/m², respectively.

Poly(2,6-dimethyl-1,4-phenylene) ether was produced by introducing oxygen into a solution of 2,6-dimethylphenol in pyridine in the presence of a cuprous chloride catalyst, and an 8% solution of the ether in toluene was prepared and used as a binder solution.

The binder solution was sprayed on each of the above obtained two kinds of webs, whereby 5% by weight, calculated as solid, of poly(2,6-dimethyl-1,4-phenylene) ether was applied to the webs. After dried in air for 2 hours, the webs were hot-pressed by means of a hot roller adjusted at 150° C to form papers having a thickness of 0.20 mm. The heat resistance and flammability of the papers were determined following to the test method described in Example 1. However, in the determination of the strength and elongation retaining percentages, the papers were heat-treated at 200° C for 10 days. The dielectric breakdown strength of the papers was determined following to JIS C 2111, 18.1. The obtained results are shown in the following Table 4.

Table 4

| Sample | Tensile strength of sample piece prior to heat treatment (Kg/mm²) | | Elongation of sample piece prior to heat treatment (%) | | Strength retaining percentage (%) | | Elongation retaining percentage (%) | | Dielectric breakdown voltage (KV/mm) |
|---|---|---|---|---|---|---|---|---|---|
| | Longitudinal direction | Transversal direction | Longitudinal direction | Transversal direction | Longitudinal direction | Transversal direction | Longitudinal direction | Transversal direction | |
| C | 14.2 | 12.2 | 4.2 | 5.2 | 76 | 65 | 85 | 79 | 7.7 |
| D | 15.8 | 13.3 | 4.3 | 5.5 | 94 | 90 | 90 | 91 | 7.9 |

From the above Table 4, it can be seen that the paper composed of phenolic fibers D containing cross-linked urea is remarkably superior in the heat resistance to the paper composed of phenolic fibers C having normal methylene cross-linkage.

When a weight of 10 g was suspended to the lower end of the same sample piece as used in the above heat resistance test, and the upper end thereof was fixed, and the sample piece was bent to an angle of 120° repeatedly 5,000 times by means of a bending-fatigue tester, cracks appeared slightly in the paper of sample C but not crack appeared in the paper of sample D.

EXAMPLE 4

In 300 cc of dioxane was dissolved 1 mol of isophthalic acid chloride. Separately, 0.5 mol of m-phenylenediamine and 0.5 mol of p-phenylenediamine were dissolved in 300 cc of dioxane. The resulting two solutions were mixed under vigorous stirring and reacted at 40° C for 2 hours. The reaction mass was poured into methanol to separate the resulting aromatic polyamide.

A 10% solution of the polyamide in dimethylformamide was prepared and used as a binder solution. The binder solution was applied to the random web composed of phenolic fibers D containing cross-linked urea, which web was prepared in Example 3, and then the random web was heat-treated at 150° C for 2 hours to obtain a paper. The paper was very flexible.

EXAMPLE 5

7 Parts of the thermoplastic novolak resin prepared in Example 1 and 3 parts of nylon-12 were melted and mixed. The melted mixture was extruded in the form of a gut, and the gut was cut into chips having a diameter of 3 mm and a length of 4 mm. The chips were charged into a melt-extruder having a diameter of 20 mm and adjusted at 200° C, and extruded through the extruder to obtain filaments of 250 d/100 f. The filaments were cut into a length of 5 cm and formed into a web having a weight of 70 g/m². The web was hardened following to the method for producing hardened fibers C in Example 3 to obtain an infusible and insoluble web. The hardened web was hot-pressed for 10 minutes under a pressure of 1.8 Kg/cm² by means of a hot press machine adjusted at 170° C to obtain a paper having a thickness of 0.3 mm. The paper had a high whiteness and a remarkably excellent printability.

EXAMPLE 6

Formaldehyde and phenol (molar ratio of formaldehydephenol being 2.2) were reacted at 60° C for 2 hours in the presence of 5 mol% of aqueous solution of sodium hydroxide to obtain an original condensate, from which the alkali was removed, and the original condensate was washed with water. Then water and unreacted products were distilled off at 95° C under 15 mmHg for 2 hours, after which methanol was added thereto to form an 8% solution of resol in methanol. Analysis of the resol resin showed that the resol resin had a molecular weight of 850 and contained methylol groups in an amount of 0.23 equivalent/phenol nucleus.

To the solution of the resol in methanol was added 5% by weight based on the resol of p-toluenesulfonic acid to prepare a binder solution.

Phenolic fibers A and B obtained in Example 1 were cut into a length of 3–5 mm respectively and subjected to carding. Thereafter, from these fibers random webs having a weight of 50 g/m² were formed by a conventional process.

These webs were impregnated with the above described binder solution and the impregnated webs were dried at 80° for 30 minutes to form paper-like products Sample E contains phenolic fibers A and Sample F contains phenolic fibers B.

The heat resistance and flammability of the resulting paper-like products were determined following to the test method described in Example 1 to obtain the result as shown in the following Table 5.

Table 5

| Sample | Tensile strength of sample piece prior to heat treatment (Kg/mm²) | | Elongation sample piece prior to heat treatment (%) | | Strength retaining percentage (%) | | Elongation retaining percentage (%) | | Flammability | |
|---|---|---|---|---|---|---|---|---|---|---|
| | Longitudinal direction | Transversal direction | Longitudinal direction | Transversal direction | Longitudinal direction | Transversal direction | Longitudinal direction | Transversal direction | Carbonization distance | Flame size |
| E | 15.3 | 13.7 | 4.3 | 5.8 | 92 | 90 | 90 | 87 | 45 mm | Small |
| F | 25.2 | 22.4 | 3.5 | 6.2 | 97 | 95 | 93 | 94 | 20 mm | No flame |

From the above Table 5, it can be seen that the paper-like products according to the present invention are high in the heat resistance and the flame resistance. Particularly, even if sample F having a high hardened degree is exposed to the fiber, said sample does not at all flame and is only carbonized in the surface of the paper.

EXAMPLE 7

Phenolic fibers A produced in Example 1 were cut into a length of 2–10 mm. The binder solution prepared in Example 6 was diluted with acetone to prepare a 1% solution of the resol in a mixture of acetone and methanol. The above obtained short-cut phenolic fibers A were immersed in the 1% resol solution and made into a sheet on a wire gauze. The sheet was dried in air at room temperature for 1 hour (the amount of the resol resin applied to the fibers: 1.5%), and then hot-pressed under a pressure of 1.5 Kg/cm² by means of a hot machine adjusted at 130° C to obtain a paper-like product having a thickness of 0.15 mm. The resulting paper-like product, which had been produced by using a small amount of binder, was tested with respect to the tensile strength, heat resistance and flammability following to the test method described in Example 1 to obtain the results as shown in the following Table 6.

Table 6

| | Tensile strength of sample piece prior to heat treatment (Kg/mm²) | | Elongation of sample piece prior to heat treatment (%) | | Strength retaining percentage (%) | | Elongation retaining percentage (%) | | Flammability | |
|---|---|---|---|---|---|---|---|---|---|---|
| | Longitudinal direction | Transversal direction | Longitudinal direction | Transversal direction | Longitudinal direction | Transversal direction | Longitudinal direction | Transversal directon | Carbonization distance | Flame size |
| Present invention | 12.1 | 10.2 | 2.5 | 4.7 | 95 | 97 | 93 | 92 | 32 mm | No flame |

From the above Table 6, it can be seen that the paper-like product of the present invention, which has been obtained by using a small amount of a binder, is somewhat inferior in the strength and elongation to the paper-like product obtained in Example 6, but is somewhat superior in the heat resistance and flammability.

EXAMPLE 8

100 Parts of the unhardened novolak fibers produced in Example 1 was immersed in 2,000 parts of a mixed aqueous solution of 18% by weight of formaldehyde and 18% by weight of hydrochloric acid at 25° C, and a temperature of the mixed aqueous solution was raised to 95° C gradually by 1 hour, and then the hardening treatment was effected for 10 minutes at this temperature, and the treated fibers were immediately washed with water to obtain partially hardened fibers.

Then, the partially hardened fibers were divided into two parts. One part of the partially hardened fibers was immersed in a mixed aqueous solution composed of 9 parts of 37% formaldehyde aqueous solution and 1 part of 30% ammonia water, and a temperature of the mixed aqueous solution was raised to 95° C by 1 hour, and then the hardening reaction was effected at 95° C for 1 hour to obtain hardened fibers G. The hardened fibers G were infusible, insoluble and non-flammable fibers having a hardened degree of 11.2%, a fineness of 3.1 d, a strength of 1.28 g/d and an elongation of 59%.

Another part of the partially hardened fibers was immersed in a mixed aqueous solution composed of 1 part of 37% formaldehyde aqueous solution, 1 part of 35% hydrochloric acid, 3 parts of methanol and 0.2 part of urea at 40° C, and a temperature of the mixed aqueous solution was raised to 63° C by 30 minutes, and then the hardening reaction was effected at this temperature for 4 hours to complete the hardening. The hardened fibers were washed with water and dried to obtain phenolic fibers H. The phenolic fibers H contained 5.7% of cross-linked urea and were light yellow insoluble, infusible and non-flammable fibers having a hardened degree of 17.5%, a fineness of 3.2 d, a strength of 1.78 g/d and an elongation of 56%.

The above obtained two kinds of fibers were cut into a length of 5 cm, and then formed into random webs having a weight of 70 g/m², respectively.

To a 5% solution of an epoxy resin made by Dow Chemical Co.) in chloroform was added 5% by weight based on the resin of dicyandiamide as a hardening agent to prepare a binder solution.

The binder solution was sprayed on each of the above obtained two kinds of webs, whereby 8% by weight, calculated as solid, of the epoxy resin was applied to the webs. After dried in air for 2 hours, the webs were hot-pressed by means of a hot roller adjusted at 120° C to form papers having a thickness of 0.20 mm. The heat resistance and flammability of the papers were determined following to the test method described in Example 1. However, in the determination of the strength and elongation retaining percentages, the papers were heat-treated at 200° C for 10 days. The dielectric breakdown strength of the papers was determined following to JIS C 2111, 18.1. The obtained results are shown in the following Table 7.

Table 7

| Sample | Tensile strength of sample piece prior to heat treatment (Kg/mm²) | | Elongation of sample piece prior to heat treatment (%) | | Strength retaining percentage (%) | | Elongation retaining percentage (%) | | Dielectric breakdown voltage (KV/mm) |
|---|---|---|---|---|---|---|---|---|---|
| | Longitudinal direction | Transversal direction | Longitudinal direction | Transversal direction | Longitudinal direction | Transversal direction | Longitudinal direction | Transversal direction | |
| G | 14.8 | 13.2 | 4.5 | 6.2 | 72 | 68 | 85 | 77 | 7.5 |
| H | 16.5 | 14.3 | 4.7 | 6.0 | 95 | 92 | 91 | 93 | 7.7 |

From the above Table 7, it can be seen that the paper composed of phenolic fibers H containing cross-linked urea is remarkably superior in the heat resistance to the paper composed of phenolic fibers G having normal methylene linkage.

When a weight of 10 g was suspended to the lower end of the same sample piece as used in the above heat resistance test, and the upper end thereof was fixed, and the sample piece was bend to an angle of 120° repeatedly 5,000 times by means of a bending-fatigue tester, cracks appeared slightly in the paper of sample G but no crack appeared in the paper of sample H.

EXAMPLE 9

The novolak resin produced in Example 1 was supplied into a blow spinning apparatus having orifices of 0.8 mm diameter and subjected to a blow spinning at high speed to produce blown fibers having a length of 0.5–20 mm. Then, the blown fibers were hardened following to Example 1 to obtain hardened phenolic fibers having a hardened degree of 23.5%.

85 Parts of the resulting phenolic fibers were thoroughly mixed with 5 parts of polyvinyl alcohol fibers having a length of 5–10 mm, and the resulting mixture was dispersed in 500 parts of an aqueous solution containing 10% by weight of a water soluble resol resin composed of phenolformaldehyde resin and then made into a sheet in a conventional manner. After dried at 70° C, the sheet was hot-pressed at 130° C for 2 minutes under a pressure of 50 Kg/cm² to obtain a paper-like product having a thickness of 0.15 mm. Water penetrated into the interior of the paper-like product sufficiently and the product had a high water absorbing property.

What is claimed is:

1. A hot pressed, heat resistant and flame resistant paper containing from 60 to 99.5 percent by weight of infusible, non-flammable phenolic fibers having fiber lengths in the range of 0.3 to 100 mm and from 0.5 to 30 percent by weight of a hardened epoxy resin as a binder, said phenolic fibers having been prepared by either (1) immersing novolak fibers in a first aqueous solution containing 0.1 to 25 percent by weight of a strong acid and 0.5 to 35 percent by weight of an aldehyde at room temperature for zero to 2 hours, raising the temperature of the first solution to from 50° to 105° C in from 0.50 to 10 hours and then maintaining the first solution at from 50° to 105° C for from zero to 2 hours to harden the outer layer of the fibers, then immersing the fibers in a second aqueous solution containing 0.2 to 15 percent by weight of ammonia or amines and one to 35 percent by weight of an aldehyde at room temperature, then raising the temperature of said second solution to 70° to 95° C in from 0.5 to 1 hour and then maintaining the solution at 70° to 95° C for 0.5 to 10 hours until the weight of the starting novolak fibers are increased from 3 to 30 percent by weight as a result of cross-linking, or (2) immersing novolak fibers in said first solution at room temperature for zero to 2 hours, raising the temperature of said first solution to 50° to 105° C in from 0.05 to 10 hours and then maintaining said first solution at 50° to 105° C for zero to 20 hours until the weight of the starting novolak fibers has increased from 3 to 30 percent by weight as a result of cross-linking, said epoxy resin being an addition product of a bisphenol or a halogenated bisphenol with epichlorohydrin.

2. The heat resistant and flame resistant paper as claimed in claim 1, wherein said phenolic fibers are a mixture of a phenolic resin and from 1 to 15 weight percent of a polyamide, copolyamide, polyester, polyesterether or polyolefin.

3. The heat resistant and flame resistant paper as claimed in claim 1, containing also from 3 to 20% by weight of polyolefin fibers.

4. The heat resistant and flame resistant paper as claimed in claim 1, wherein said phenolic fibers have a fineness of 0.1–20 deniers.

5. The heat resistant and flame resistant paper as claimed in claim 4 in which the amount of said epoxy resin is from 1 to 25 percent by weight.

6. The heat resistant and flame resistant paper as claimed in claim 4 in which the amount of said epoxy resin is from 3 to 20 percent by weight.

7. A hot-pressed, heat resistant and flame resistant paper containing from 60 to 99.5 percent by weight of infusible, non-flammable phenolic fibers having fiber lengths in the range of 0.03 to 100 mm and from 0.5 to 30 percent by weight of a hardened epoxy resin as a binder, said phenolic fibers having been prepared by immersing novolak fibers in a first aqueous solution containing 0.1 to 25 percent by weight of a strong acid and 0.5 to 35 percent by weight of an aldehyde at room temperature for zero to 2 hours, raising the temperature of the first solution to from 50° to 105° C in from 0.05 to 10 hours and then maintaining the first solution at from 50° to 105° C for from zero to 2 hours to harden the outer layer of the fibers, then immersing the fibers in a second aqueous solution containing 0.1 to 25 percent by weight of an acidic catalyst or a basic catalyst, one to 30 percent by weight of an aldehyde, 0.5 to 15 percent by weight of a substance selected from the group consisting of urea, thiourea, methylol derivatives of urea and thiourea, ethyleneurea, ethylenethiourea and methylol derivatives of ethylene urea and ethylenethiourea, and one to 50 percent by weight of an alcohol, a ketone or an ether, at room temperature, then raising the temperature of said second solution to 50° to 95° C in from 0.5 to 2 hours and then maintaining the second solution at 50° to 95° C for 0.5 to 25 hours until the weight of the starting novolak fibers has increased from 3 to 30 percent by weight as a result of cross-linking, said epoxy resin being an addition product of a bisphenol or a halogenated bisphenol with epichlorohydrin.

8. The heat and flame resistant paper as claimed in claim 7, containing also from 3 to 20% by weight of polyolefin fibers.

9. The heat resistant and flame resistant paper as claimed in claim 7, wherein said phenolic fibers are a mixture of a phenolic resin and from 1 to 15 weight percent of a polyamide, copolyamide, polyester, polyesterether or polyolefin.

10. The heat resistant and flame resistant paper as claimed in claim 7, wherein said phenolic fibers have a fineness of 0.1–20 deniers.

11. The heat resistant and flame resistant paper as claimed in claim 10 in which the amount of said epoxy resin is from 1 to 25 percent by weight.

12. The heat resistant and flame resistant paper as claimed in claim 10 in which the amount of said epoxy resin is from 3 to 20 percent by weight.

* * * * *

UNITED STATES PATENT AND TRADEMARK OFFICE

CERTIFICATE OF CORRECTION

PATENT NO. : 4 067 769

DATED : January 10, 1978

INVENTOR(S) : Koichiro Ohtomo and Tsuyoshi Nakamori

It is certified that error appears in the above-identified patent and that said Letters Patent are hereby corrected as shown below:

Change second inventor's name from "Tsuyoshi Nakamo" to ---Tsuyoshi Nakamori---.

Column 13, line 57; change "0.50" to ---0.05---.

Column 13, line 67; change "are" to ---has---.

Column 14, line 44; change "0.03" to ---0.3---.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*